United States Patent [19]

Rollman

[11] Patent Number: 5,011,032

[45] Date of Patent: Apr. 30, 1991

[54] PATIENT DOSAGE REGIMEN COMPLIANCE BOTTLE CAP

[76] Inventor: Bruce L. Rollman, 662 Melvin Dr., Baltimore, Md. 21230

[21] Appl. No.: 486,298

[22] Filed: Feb. 28, 1990

[51] Int. Cl.[5] ..... B65D 51/24; G09F 9/40

[52] U.S. Cl. ..... 215/230; 215/224; 206/534; 206/540; 221/4; 116/323; 116/321

[58] Field of Search ..... 215/230, 224; 220/339; 206/534, 540; 221/4, 5; 116/308, 321, 323, 324, 205, DIG. 17; 40/311

[56] References Cited

U.S. PATENT DOCUMENTS

| | | | |
|---|---|---|---|
| 2,066,183 | 12/1936 | Mehaffey | 215/230 |
| 2,791,846 | 5/1957 | Muelberger, Jr. | 4/311 |
| 3,151,599 | 10/1964 | Livingston | 215/230 |
| 3,227,127 | 1/1966 | Gayle | 215/230 |
| 3,766,882 | 10/1973 | Babbitt, III | 215/230 |
| 3,960,713 | 6/1976 | Carey | 215/230 |
| 4,208,983 | 6/1980 | Buckley | 206/539 |
| 4,358,032 | 11/1982 | Libit | 215/224 |
| 4,528,933 | 7/1985 | Allen | 215/230 |
| 4,666,051 | 5/1987 | Trick | 215/230 |
| 4,712,504 | 12/1987 | Zarley et al. | 116/323 |
| 4,749,093 | 6/1988 | Trick | 215/230 |
| 4,883,180 | 11/1989 | Humphrey et al. | 206/534 |
| 4,895,257 | 1/1990 | Winslow | 206/534 |
| 4,951,596 | 8/1990 | Wallace, Jr. | 116/323 |

*Primary Examiner*—Stephen Marcus
*Assistant Examiner*—Paul A. Schwarz
*Attorney, Agent, or Firm*—Gerald S. Rose

[57] ABSTRACT

A solid dosage unit dispenser closure cap suitable for use by sight-impaired persons and/or persons with physical incapability to unscrew caps of prescription bottles or containers having a lid integrally attached an annular skirt by a living hinge, wherein the lid has a tab to enable the patient to open the cap easily without twisting. In addition the container for the medicine has a ring attached thereto and to the inner surface of the skirt at the inside near the opening thereof. The ring has an opening sufficiently large to allow only one or perhaps two dosage units to be spilled out by the patient at one time, in addition the ring has a slide attached thereto which can be moved by the patient circumferentially on the ring to stop at indicia on the top of the ring which reminds the patient which dose was last taken or which dose is yet to be taken. A window on the top leg of the slide permits viewing or feeling the indicia. The cap can also have dosage regimen indicia on the top outer surface of its lid and/or on and annular skirt displaying the number of medication units to take at each administration, e.g., braille, removable tabs, numbers and the like, and being adapted to be attached to the medicine container. Finally, the cap can be color coded to identify the dosage frequency.

7 Claims, 4 Drawing Sheets

FIG. 6 ONE DOSE PER DAY
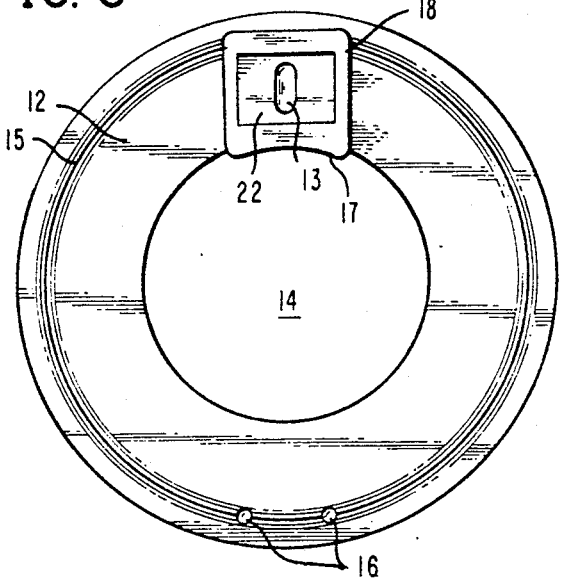
FIG. 6a TWO DOSES PER DAY
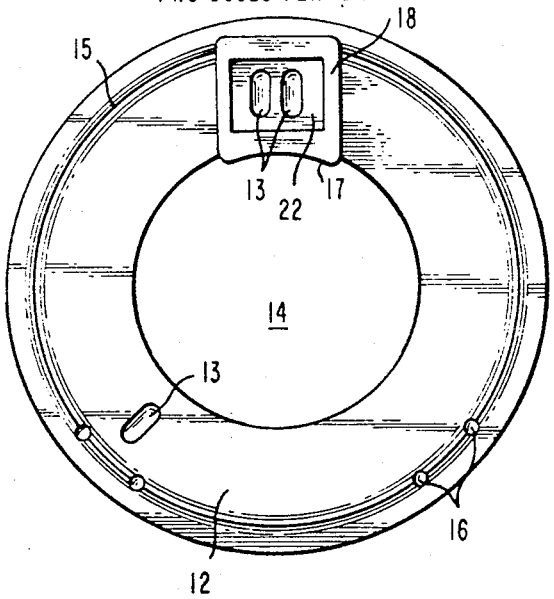
FIG. 6b THREE DOSES PER DAY
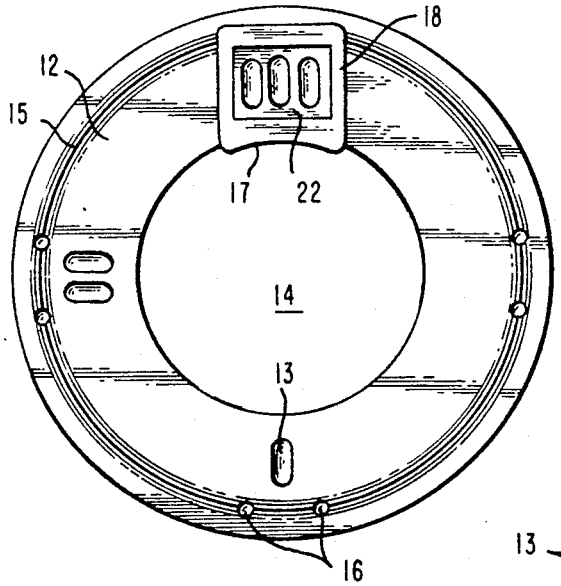
FIG. 6c FOUR DOSES PER DAY
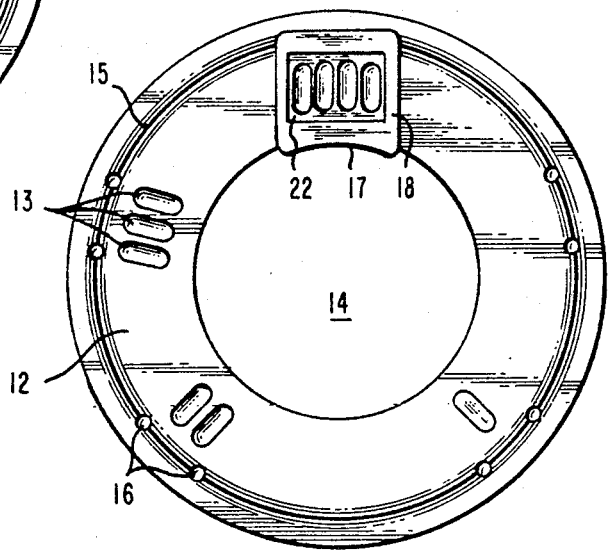

PATIENT DOSAGE REGIMEN COMPLIANCE BOTTLE CAP

BACKGROUND

It is common practice for physicians to prescribe medications in pills, tablets, capsules and other solid oral dosage forms from a pharmacy. In writing out such prescriptions, the physicians state that a dose, e.g. pill or pills, must be taken at specific time intervals, for example, two pills every six hours. Such dose and time intervals are usually typed onto a label attached to the medicine container, usually an opaque or semi-opaque cylindrical plastic container. In many cases, such labeling is unsatisfactory because the labels cannot be read by the patient, the information thereon may become smeared or the label detached. In addition, patients with severe arthritis or similar maladies of the hands often find it troublesome, if not impossible, to open the standard child-proof or child-resistant medicine container.

The memory of patients is not always reliable and there are many circumstances under which the patient forgets when the last dose was taken and is thus uncertain when to take the next dose. Such problems make it difficult for the normal person, as a patient, to determine the dosage regimen and nearly impossible for persons visually impaired, blind, arthritic with strength or dexterity problems or those mentally impaired in any way to properly follow the prescription instructions.

Efforts to solve this general problem of non-compliance have had varying degrees of success. Thus, Buckley, U.S. Pat. No. 4,208,983, discloses a means to identify a dosage regimen by indicia on a cap on a container of medicine or on a label fixed to the outer surface of a container. Buckley discloses a device comprised of at least two portions; one of which has a relief symbol representing a tablet and a plurality of protrusions extending therefrom which may be selectively removed to leave the specific number of protrusions representing the specified dosage, i.e. three protrusions means three tablets; the second portion of which has a relief symbol representing time and a plurality of protrusions extending therefrom which may be selectively removed to leave the specific number of protrusions to represent the time cycle of the dosage, thus the prescription is duplicated by indicia on the cap. There is nothing to indicate to the patient if he or she has taken a previous dose. Gayle, U.S. Pat. No. 3,227,127 discloses a pill dispenser that provides for an automatic recording or registering of the fact that the patient has taken a pill at the prescribed interval. The pill dispenser and indicator of Gayle comprise a relatively small pocket size dispenser containing a predetermined number of pills to be used over a prescribed period of time. The dispenser has a separate compartment for each pill and includes a disc base and a disc cover. The pill containing compartments are spaced about the perimeter of the disc base. The cover has an access opening for removing one pill at a time. Contained within the disc base and cover is an indicating dial having calibrated markings, a portion of which is visible through the cover of the dispenser. This dial is engaged with the base of the dispenser whereby rotation of the cover relative to the base, a step necessary to remove a pill, will advance the dial with respect to a reference means on the cover. Thus, whenever a pill is removed from the dispenser the indicating dial is automatically advanced, and consequently, the patient need not rely on memory. Such a device relies on visual indicia to remind the patient, however, such indicia are not suitable for blind or sight impaired patients.

Zoltan, U.S. Pat. No. 4,419,016, discloses a compliance aid device which enables users to readily ascertain the time at which they took a previous dose of medication. This is achieved through the provision of a time keeping device incorporated into typical containers for medicinal products without the need for complicated container construction or complex mechanical parts or expensive electronic circuitry. The time keeping device displays the time and date when the container was last opened by the patient user and continues to display them after closing of the container. The device can also be provided with settable alarms to visually or audibly alert the patient as to when the next dose is to be taken. The Zoltan device can be provided as a separate element or as part of the cap or cover of the container and can be reused. This device depends upon electronics, is expensive and does not meet the needs of sight impaired and blind patients or certain deaf patients.

Babbitt, III, U.S. Pat. No. 3,766,882, provides a pill dispensing device in the shape of a cylindrical body of plastic having an open top with an outwardly projecting bead at the open top, and a scale in the form of a band including hourly designations which is applied about the cylindrical body beneath the bead. A cap rotates relative to the body of the cylinder. The cap has time indicia in the form of a line on the outside surface of its skirt. When the cap is turned after each time the medicine is taken by the patient, the time of the last dose is indicated and can serve as a memory aid for the patient. The Babbitt device is not suitable for persons with poor sight, does not provide aid in determining frequency of dosing and does not indicate when the next dose is to be taken.

SUMMARY

The present invention overcomes disadvantages associated with prior art attempts to provide medicine dispensers suitable for use by the sight and/or hearing impaired as well as physically impaired persons who have difficulty opening caps. Said caps indicate the dosage regimen and inform the patient of the number of dosages already taken.

The above are accomplished by this invention which provides a medicine container cap, preferably a cap adapted to be attached to a medicine bottle in the so-called child-proof or child-resistant manner, comprising an indicia bearing lid integrally attached by a so-called "living hinge" to an indicia bearing skirt or ring. The container cap is adapted to be attached to and act as a closure for a medicine dispenser containing solid dosage forms. The cap is opened and closed by lifting the lid open and by pushing it closed. Inside the skirt of the cap there is adapted to be concentrically positioned in the neck of a medicine container neck at the opening for removing the dosage forms, a restricted opening structure (ring) which has indicia signifying the number of dosages already taken or to be taken in the particular time period involved. This is indicated by a freely movable slide that is attached to and moves circumferentially around the said ring. The restricted opening structure aids in reducing the incidence of accidental spilling of the medicine out of the dispenser when the patient is removing the medicine. The cap is preferably color coded to indicate the number of times per day the medicine is to be taken. In addition, and of importance to the sight impaired, the outside of the top wall of the cap, i.e. the lid, has indicia to identify the number of times the pills, capsules or tablets must be taken each day. The indicia can be raised numbers, braille, or other code such as letters. The indicia corresponds to the color of the cap in a predetermined standardized relationship. The indicia may also tell the time of day the medicine must be taken, e.g. A.M. or P.M. The ring or cylindrical skirt part of the cap can be attached to a standard medicine container bottle preferably as a child-proof or child-resistant closure to decrease the likelihood of a person accidently switching the prescription medicine bottle cap with associated coding information onto another prescription medicine bottle containing a dofferent medicine. The cylindrical skirt of the cap has indicia thereon which can be read or felt, informing the patient how many dosage units, e.g. pills, capsules or tablets, are to be taken at each time interval. The indicia can be in braille or be raised numbers or can be tabs which the pharmacist can adjust to signify the number of dosage units of medicine to be taken at each interval.

BRIEF DESCRIPTION OF DRAWINGS

The invention can be more fully understood by reference to the accompanying drawings wherein:

FIGS. 6, 6*a*, 6*b* and 6*c* are top plan views of the inner ring of the cap showing the slide and indicia.

DESCRIPTION OF THE INVENTION

Figure 1:
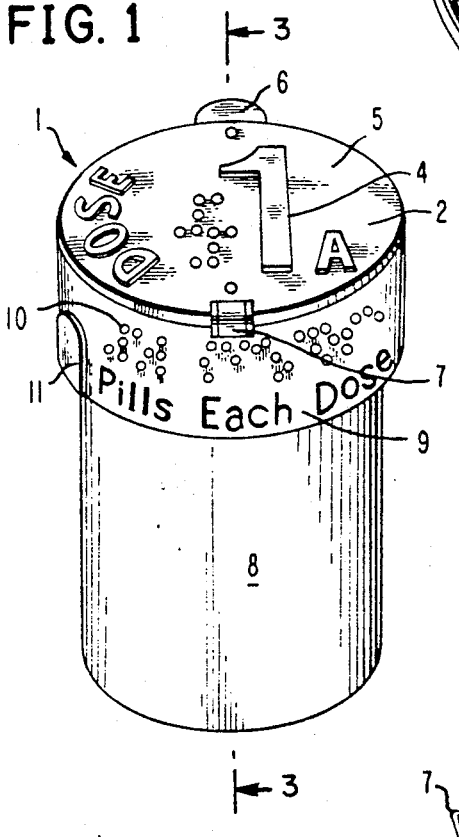
FIG. 1 is a perspective view illustrating the medicine dispenser bottle cap of this invention with the lid of the cap closed.

Referring now to the drawings, wherein like reference characters denote corresponding parts.

FIG. 1 shows the dosage regimen bottle cap 1 of this invention comprising a lid 2 with raised indicia 4 on the top surface 5 thereof, a tab 6 for grasping to open the lid 2, an integral living hinge 7, said hinge 7 being in its preferred embodiment integral with said lid 2 and an annular ring or skirt 9 of the cap 1. The annular skirt or ring 9 contains in its preferred embodiment raised indicia 10 and removable break-off tabs 11. The cap 1 is adapted to be attached to a conventional prescription medicine container 8, including one with the ability to attach to a child-proof or child resistant cap.

The solid dosage forms which are put into the container 8 by the pharmacist are pills, capsules or tablets or any other conventional solid dosage form. The raised indicia 4 on the top surface 5 of the lid 2 of the cap 1 are braille, numbers, letters and the like which can be molded with the cap 1 during manufacture or adhered to the cap 1 by the distributor, pharmacist or prescriber or any other person delegated to accomplish the task. The annular ring or skirt 9 has raised indicia 10 such as braille on the outer surface thereof as well as break-off tabs 11 which indicate to the patient the number of dosage units, e.g. pills to take. The indicia 10 can be molded into the annular skirt 9 during manufacture thereof or can be adhered to it after manufacture in the same manner and by the same persons as in the case of the top 5 of the lid 2. The break-off tabs 11 are molded as part of the annular skirt 9 during manufacture. The lid 2, the skirt 9, and the living hinge 7 are molded together from thermosetting plastic which is approved for storing medicine. The cap 1 can be color coded to inform the patient of the number of times a day the medicine must be taken. If the indicia 4, is molded onto the top surface 5 of the lid 2, the pharmacist merely takes the appropriate item from stock when filling the prescription and the color of the cap 2 will correspond to its indicia 4. Thus, if the color is blue, the medicine is taken three times a day, if the color is green or red, the medicine is taken once a day, if the color is yellow, the medicine is taken twice a day and if the color is orange, the medicine is taken four times a day. The numbered indicia are preferably white for contrast to ease the observation thereof.

Figure 4:
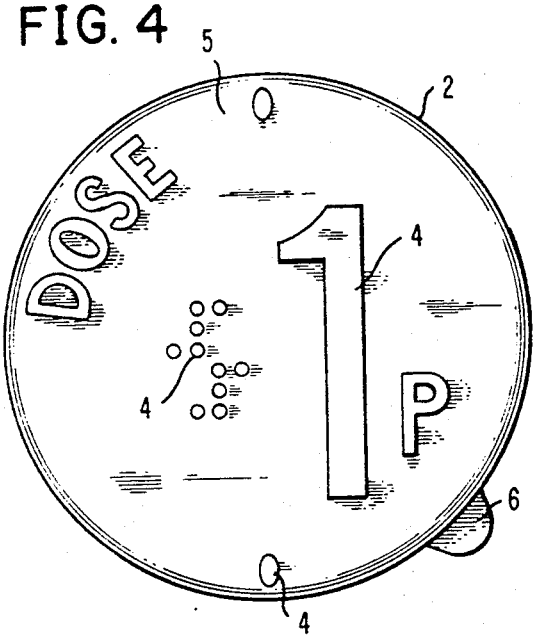
FIGS. 4, 4*a*, 4*b* and 4*c* are top plan views of the cap showing indicia.
Figure 4A:
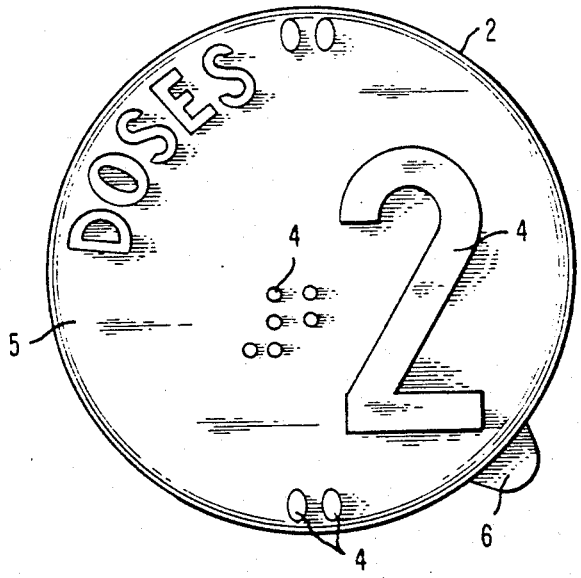
Figure 4B:
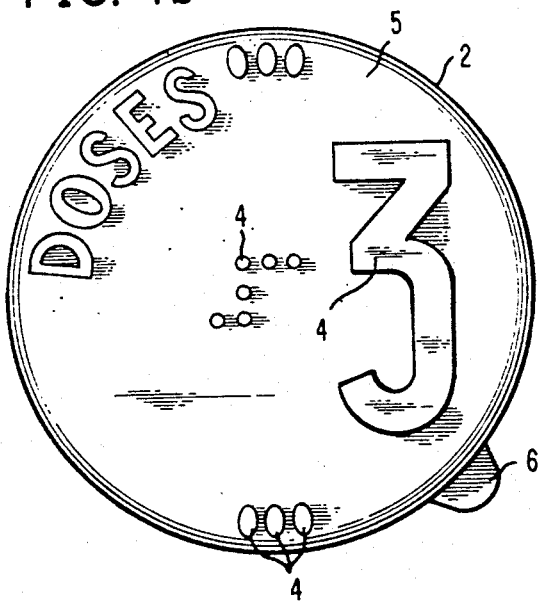
Figure 4C:
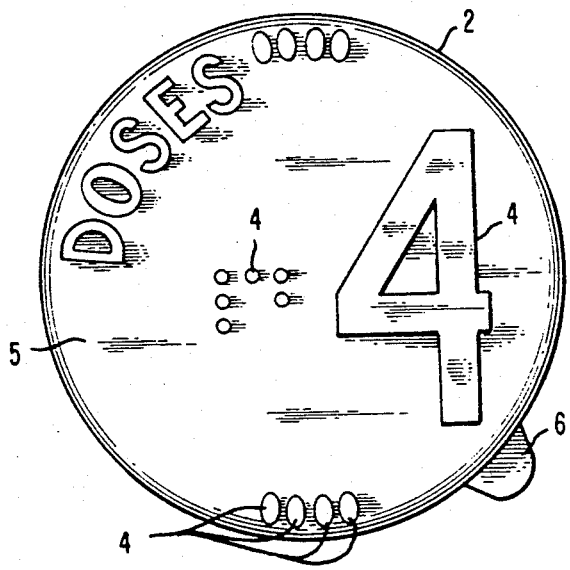
Figure 5:
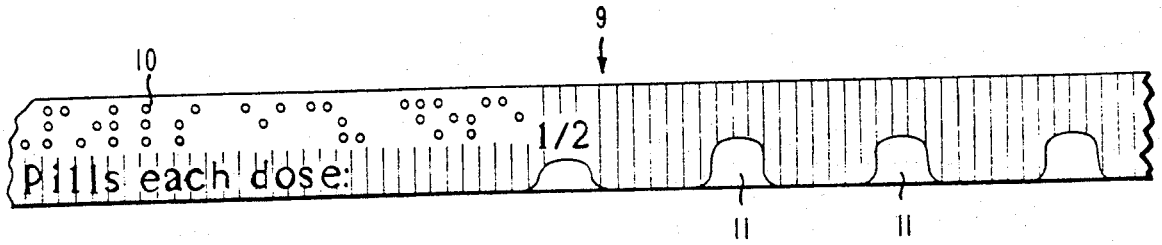
FIG. 5 is a plan view of the skirt of the cap in extended flat position showing indicia.
Figure 7:
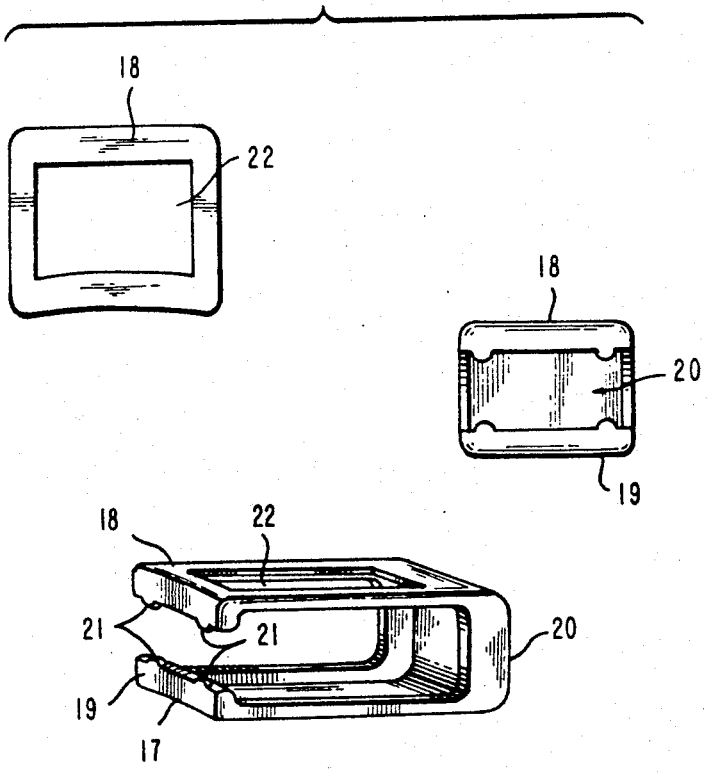
FIG. 7 is a perspective view of the slide.

The indicia 4 on the top 5 of the lid 2 can be braille to inform sight impaired patients, i.e. how many dosages to take each time, how many times a day to take the medicine and when to take the medicine, e.g. morning or night, as well as the time to start. For patients not sight impaired, the indicia can be as shown in FIGS. 1, 4, 4*a*, 4*b* and 4*c*. Thus, in FIG. 4, the indicia inform the patient to take one tablet, capsule or pill in the afternoon. For those sight impaired patients without knowledge of braille, the numeral "1" and the "P" in FIG. 4 are raised as are the tabs at 12 o'clock and 6 o'clock on the top 5 of the lid 2. Similarly, FIG. 4*a* illustrates both braille and non-braille indicia which informs the patient to take tablets, pills or capsules twice a day. FIGS. 4*b* and 4*c*, respectively, inform the patient to take the medicine 3 and 4 times a day. In addition, the specific color of the cap 1 informs the patient of the regimen to follow.

The skirt 9 in FIG. 1 has raised indicia 10 in braille, for example, and tabs 11 which inform the patient how many tablets, pills or capsules shoul be taken at each administration. This is accomplished by the pharmacist who removes the appropriate tabs 11.

In accordance with this invention, indicia can be provided to inform the patient of the dosage regimen. The drawings are for illustration only to show the versatility of the invention.

One problem with all patients is that it becomes difficult to remember which dose of medicine was taken last. This is solved according to this invention as illustrated in FIGS. 2, 3, 6, 6*a*, 6*b*, 6*c* and 7. Referring now to FIGS. 3, 6, 6*a*, 6*b*, and 6*c*, a ring 12 is fixedly inserted or molded to the inside surface of the annular skirt 9 just below the top edge of the skirt 9. The ring 12 has on the top surface thereof lowered indicia or notches 13 informing the patient how many times in the day or other time period the medicine has been or needs to be yet taken. The center opening 14 in the ring 12 reduces the opening size of the container 8 and cap 1 so that it is more difficult to dispense greater than one dosage unit at a time. This helps prevent losses if extra pills, capsules or tablets are accidently poured into the patients hand and dropped, or the container 8 is either dropped or tipped over when open. The ring 12 is preferably made of molded plastic. It has a centering groove 15 which has aligning indentations 16 in the vicinity of the lowered indicia 13. The centering groove 15 receives a slide device 17, illustrated in FIG. 7 and shown in FIG. 3 in a side sectional view. The slide device 17 is semi-flexible and U-shaped so it can be inserted onto the ring 12. The indicia on the ring 12 corresponds to the indicia on the top surface 5 of the lid 2, e.g., if the lid 2 shows a three times a day administration regimen, the ring 12 would be as in FIG. 6*b*.

Figure 3:
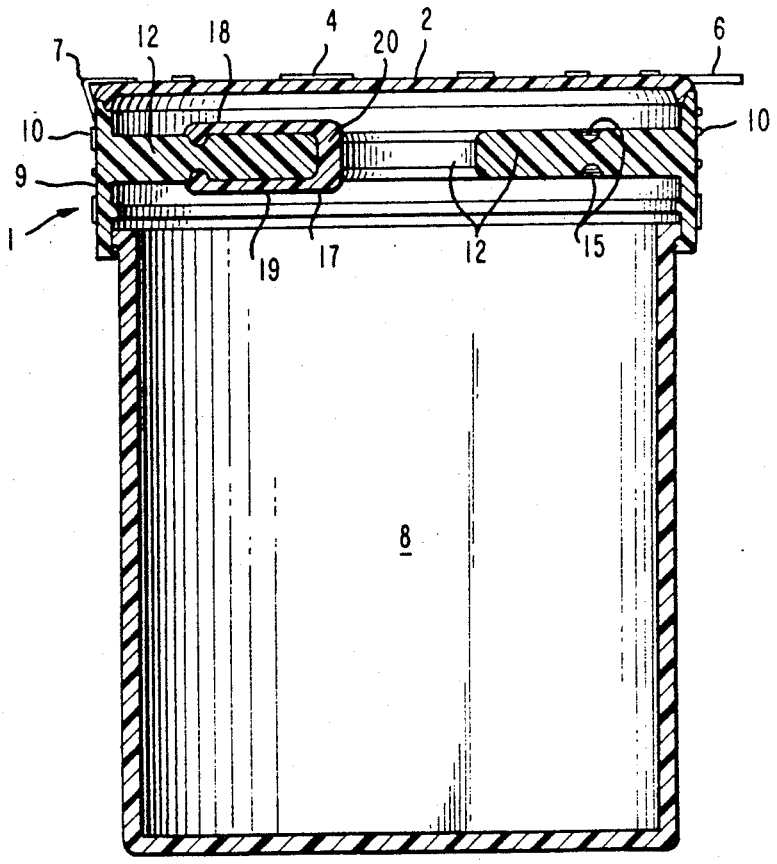
FIG. 3 is a side sectional view of the dispenser bottle cap with the lid of the cap closed taken along line 3—3 of FIG. 1.

The U-shaped slide 17 has an upper leg 18 and a lower leg 19 connected at one end thereof by a base 20 to form the U-shape. Each leg 18, 19 has at the unconnected end thereof a raised notch 21 laterally displaced on each corner of the legs 18, 19 and depending inwardly so that when the slide 17 is pushed onto the ring 12, the notches 21 on each leg 18, 19 slide into the centering grooves 15 as shown in FIG. 3. The legs 18, 19 are sufficiently flexible to fit over the ring 12, but have sufficient elasticity to hold snugly to the grooves 15 by the notches 21. The top leg 18 of the slide 17 has an opening or window 22 which permits the patient to see or feel the lowered indicia 13 and be reminded of the number of doses to take or that have been taken. The slide 17 is laterally slideable so it can be moved clockwise or counterclockwise following the circumferential grooves 15 from one set of indicia 13 to the next set. When the next set of indicia 13 are reached, the notches 21 fall into the aligning indentations 16. The slide 17 is thus fixed into position until the patient moves it again after taking the next dose of medicine, thus keeping the patient reminded which dose was last taken and which dose is to be taken, or vice versa, according to the patients preference. The ring 12 thus serves two functions, to prevent excess units of medicine from coming out of the container and to remind the patient which dose should be taken and if the previous dose has been taken, or vice versa.

Figure 2:
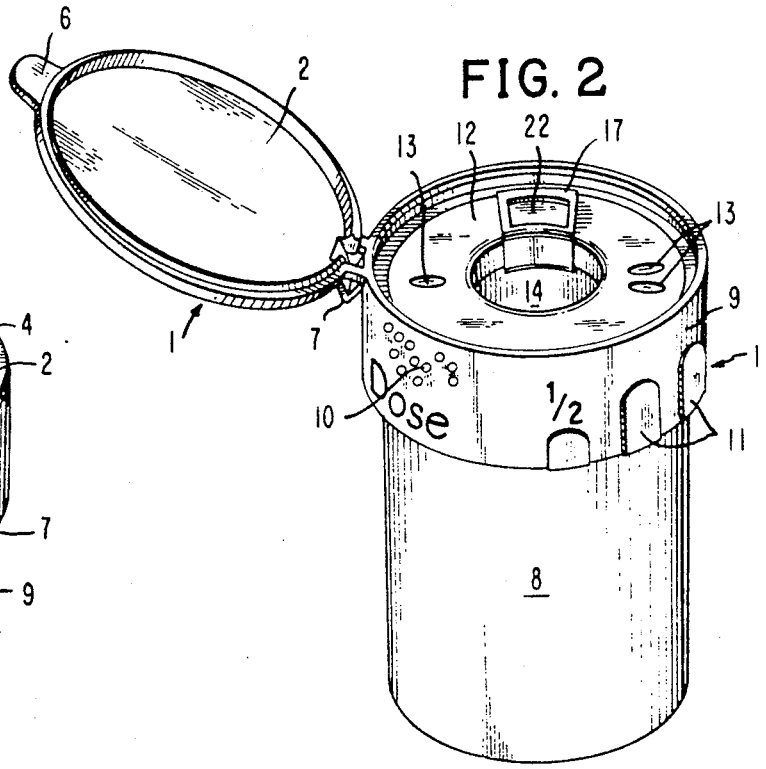
FIG. 2 is a perspective view illustrating the medicine dispenser bottle cap of this invention with the lid of the cap open.

FIG. 2 illustrates the open cap 1 on a medicine container 8. The lid 2 is opened when the patient pulls upward on the tab 6 on the perimeter of the lid 2 opposite the living hinge 7. Although opening tablet, pill or capsule container closures does not cause problems with all patients, a person with arthritis of the hands, or otherwise weakened, has great difficulty unscrewing the cap from conventional screw-top medicine containers, particularly child-proof or child-resistant caps. Thus, with minimal effort, the lid 2 of the cap 1 used in this invention can be opened by pulling the perimeter tab 6 upward and closed by pushing the lid 2 down onto the neck of the skirt 9 of the cap 1.

The cap 1 of this invention when attached to a medicine container is used as follows.

When a prescription for a patient is filled, the pharmacist puts the tablets, pills or capsules (herein generically referred to as solid dosage units) into a container therefor, the pharmacist makes certain that the container has the proper number of solid dosage units therein, and chooses the cap with the proper indicia and color corresponding to the intended dosages per unit time, typically 24 hours, as prescribed by the patient's physician. The pharmacist then breaks off the tab from the skirt which corresponds to the number of solid dosage units to take at each interval before attaching the cap to the container which holds the total number of solid dosage units prescribed.

In cases where sight impaired (including blind persons) patients will be taking the medicine, the pharmacist must be sure braille and/or other proper raised or lowered indicia are present. For those not sight impaired, proper visual aids must be present, i.e. numbers, time of day, colors, dosage unit indicia on the ring, etc. In special cases where only the patients memory needs to be jogged, indicia on the ring with the dosage regimen printed on the label of the container is sufficient and that embodiment is intended to be part of this invention.

After the patient obtains the prescription in the medicine container having the cap of this invention attached thereto, he or she follows the directions on the cap, skirt and/or label, as the case may be, and self-medicates, then moves the slide on the ring to the next indicia so as to be reminded that the dose of medicine was taken on schedule. Access to the medicine is simply accomplished by opening the container by grasping the tab on the lid of the cap and pulling upward. The medicine is removed by tipping the container so the solid dosage spills out. Because of the restricted opening as a result of the ring in the container, there is less chance that the patient will inadvertently spill the medicine. After the medicine is taken, the patient moves the slide on the ring clockwise (counter clockwise can also be used) to the next indicia. The patient then closes the lid of the cap over the container opening by downward pressure. Since the container with the cap of this invention is not childproof, very little pressure is needed to open or close the lid of the cap.

Although this invention is especially intended for use when the patient self-medicates, it can also be used by a family caretaker or nurse or other person administring medicine to patients in a variety of settings such as in nursing homes and the like.

I claim:

1. A closure cap adapted for attachment to the neck of a standard prescription medicine container to aid patient compliance of a dosage regimen of solid dosage units of medicine such as pills, capsules and tablets comprising a lid with a skirt integrally connected thereto by a living hinge wherein:

(a) said skirt is adapted to attach to a prescription medicine container open neck, said skirt having a ring attached on the inside surface thereof, said ring having a center hole of a diameter which permits one dosage unit to pass therethrough at a time and being attached on said skirt so that when said skirt is attached to said container neck, the ring opening is concentric with said open neck of said container, said ring having indicia on the top surface thereof which displays the number of times medicine is taken or is to be taken in a time frame, said ring also having on the top and bottom surfaces thereof a circumferential groove intermediate the center hole and the inside edge of the neck of the container and having movably attached thereto a U-shaped slide with a non-rigid upper leg and a lower leg wherein the upper leg has means to fit in the upper groove and the lower leg has means to fit in the lower groove, said upper leg having an opening therein enabling the user to see or feel the indicia on the top surface of said ring providing the number of the last dosage taken or remaining dosage to be taken in the reference time frame and said skirt having on its outer surface indicia displaying the number of medication units to be taken during each time period the medicine must be taken;

(b) said lid of said cap having a tab on the outside periphery thereof for the patient to pull said lid upward to the open position unsealing the opening of said container, the top surface of said lid having indicia thereon displaying the dosage regimen per unit time and the outer surface of said annular skirt having indicia displaying the number of medication units to take during each time period the medicine must be taken.

2. The cap of claim 1 wherein the indicia on the top surface of said ring comprises lowered notches.

3. The cap of claim 1 wherein the indicia on the annular skirt comprises braille.

4. The cap of claim 1 wherein the indicia on the annular skirt comprises a number.

5. The cap of claim 1 wherein the indicia on the annular skirt comprises removable tabs.

6. The cap of claim 1 wherein the indicia on top of the lid is raised dots, braille, raised numerals, raised letters or any combination thereof.

7. The cap of claim 6 which is color-coded to correspond to the meaning of the indicia on the top surface of the lid and the top surface of said ring.

* * * * *